US008917266B2

(12) United States Patent
Park et al.

(10) Patent No.: US 8,917,266 B2
(45) Date of Patent: Dec. 23, 2014

(54) TIMING CONTROLLER AND A DISPLAY DEVICE INCLUDING THE SAME

(75) Inventors: Yong-Yun Park, Seoul (KR); Jong-Seon Kim, Seongman-si (KR); Ki-Joon Kim, Suwon-si (KR); Min-Hwa Jang, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 260 days.

(21) Appl. No.: 13/439,388

(22) Filed: Apr. 4, 2012

(65) Prior Publication Data

US 2012/0299974 A1 Nov. 29, 2012

(30) Foreign Application Priority Data

May 23, 2011 (KR) ..... 10-2011-0048228

(51) Int. Cl.

| | |
|---|---|
| ***G09G 5/10*** | (2006.01) |
| ***G09G 3/20*** | (2006.01) |
| ***G09G 3/36*** | (2006.01) |
| *G09G 5/36* | (2006.01) |

(52) U.S. Cl.

CPC ..... *G09G 3/2096* (2013.01); *G09G 5/363* (2013.01); *G09G 2300/0842* (2013.01); *G09G 2360/18* (2013.01); *G09G 3/3688* (2013.01); *G09G 2330/04* (2013.01); *G09G 2340/16* (2013.01); *G09G 2230/00* (2013.01); *G09G 2300/0426* (2013.01); *G09G 2310/0286* (2013.01); *G09G 2320/103* (2013.01); *G09G 2310/0294* (2013.01); *G09G 2310/0291* (2013.01); *G09G 2340/02* (2013.01)

USPC ..... 345/213; 345/99; 345/204; 345/690; 375/355; 327/141; 326/93

(58) Field of Classification Search

USPC ..... 326/31, 93; 327/141; 345/88–89, 345/99–100, 173, 204, 211–213, 690; 375/355, 371; 377/78

See application file for complete search history.

(56) References Cited

U.S. PATENT DOCUMENTS

| | | | | |
|---|---|---|---|---|
| 6,339,833 | B1 * | 1/2002 | Guo | 714/55 |
| 6,448,962 | B1 * | 9/2002 | McKnight et al. | 345/205 |
| 8,020,131 | B1 * | 9/2011 | Van Mau et al. | 716/116 |
| 2009/0085624 | A1 * | 4/2009 | Yoon et al. | 327/175 |
| 2009/0177930 | A1 * | 7/2009 | Park | 714/49 |
| 2009/0292840 | A1 * | 11/2009 | Konnail et al. | 710/61 |
| 2010/0171737 | A1 * | 7/2010 | Bae et al. | 345/213 |
| 2010/0201899 | A1 | 8/2010 | Yamamoto | |
| 2011/0037758 | A1 * | 2/2011 | Lim et al. | 345/213 |
| 2011/0095815 | A1 * | 4/2011 | Higuchi | 327/551 |

FOREIGN PATENT DOCUMENTS

| | | |
|---|---|---|
| JP | 2010-182921 | 8/2010 |
| KR | 1020070090310 | 9/2007 |
| KR | 1020080052907 | 6/2008 |

* cited by examiner

*Primary Examiner* — Lun-Yi Lao
*Assistant Examiner* — Elliott Deaderick
(74) *Attorney, Agent, or Firm* — F. Chau & Associates, LLC

(57) ABSTRACT

A timing controller that includes a noise detection circuit and a setting control unit. The noise detection circuit includes a detection unit and a reset signal generating unit. The detection unit outputs a detection signal having a first logic level based on at least one of a plurality of reference data toggling asynchronous with a clock signal. The reset signal generating unit outputs a reset signal having a second logic level based on the detection signal. The setting control unit stores setting data and initializes the setting data in response to the reset signal having the first logic level, and the setting data are used to process red, green and blue (RGB) image data.

10 Claims, 15 Drawing Sheets

FIG. 11

| FF1 | FF2 | FF3 | FF4 | FF5/D | FF5/Q | FF5/QN | GRST |
|---|---|---|---|---|---|---|---|
| 0 | 0 | 0 | 0 | 1 | 1 | 0 | 0 |
| 0 | 0 | 0 | 1 | 1 | 1 | 0 | 0 |
| 0 | 0 | 1 | 0 | 1 | 1 | 0 | 0 |
| 0 | 0 | 1 | 1 | 1 | 1 | 0 | 0 |
| 0 | 1 | 0 | 0 | 1 | 1 | 0 | 0 |
| 0 | 1 | 0 | 1 | 0 | 0 | 1 | 1 |
| 0 | 1 | 1 | 0 | 1 | 1 | 0 | 0 |
| 0 | 1 | 1 | 1 | 1 | 1 | 0 | 0 |
| 1 | 0 | 0 | 0 | 1 | 1 | 0 | 0 |
| 1 | 0 | 0 | 1 | 1 | 1 | 0 | 0 |
| 1 | 0 | 1 | 0 | 0 | 0 | 1 | 1 |
| 1 | 0 | 1 | 1 | 1 | 1 | 0 | 0 |
| 1 | 1 | 0 | 0 | 1 | 1 | 0 | 0 |
| 1 | 1 | 0 | 1 | 1 | 1 | 0 | 0 |
| 1 | 1 | 1 | 0 | 1 | 1 | 0 | 0 |
| 1 | 1 | 1 | 1 | 1 | 1 | 0 | 0 |

FIG. 14

| DS1 | DS2 | DS3 | DS4 | FF6/D | FF6/Q | FF6/QN | GRST |
|---|---|---|---|---|---|---|---|
| 0 | 0 | 0 | 0 | 0 | 0 | 1 | 1 |
| 0 | 0 | 0 | 1 | 1 | 1 | 0 | 0 |
| 0 | 0 | 1 | 0 | 1 | 1 | 0 | 0 |
| 0 | 0 | 1 | 1 | 1 | 1 | 0 | 0 |
| 0 | 1 | 0 | 0 | 1 | 1 | 0 | 0 |
| 0 | 1 | 0 | 1 | 1 | 1 | 0 | 0 |
| 0 | 1 | 1 | 0 | 1 | 1 | 0 | 0 |
| 0 | 1 | 1 | 1 | 1 | 1 | 0 | 0 |
| 1 | 0 | 0 | 0 | 1 | 1 | 0 | 0 |
| 1 | 0 | 0 | 1 | 1 | 1 | 0 | 0 |
| 1 | 0 | 1 | 0 | 1 | 1 | 0 | 0 |
| 1 | 0 | 1 | 1 | 1 | 1 | 0 | 0 |
| 1 | 1 | 0 | 0 | 1 | 1 | 0 | 0 |
| 1 | 1 | 0 | 1 | 1 | 1 | 0 | 0 |
| 1 | 1 | 1 | 0 | 1 | 1 | 0 | 0 |
| 1 | 1 | 1 | 1 | 1 | 1 | 0 | 0 |

TIMING CONTROLLER AND A DISPLAY DEVICE INCLUDING THE SAME

CROSS-REFERENCE TO RELATED APPLICATION

This application claims priority under 35 U.S.C. §119 to Korean Patent Application No. 10-2011-0048228, filed on May 23, 2011, in the Korean Intellectual Property Office (KIPO), the disclosure of which is incorporated by reference herein in its entirety.

BACKGROUND

1. Technical Field

The inventive concept relates to displays, and more particularly, to a timing controller and a display device including the same.

2. Discussion of the Related Art

A liquid crystal display is one of the most widely used flat panel displays. For example, a liquid crystal display can be found in a variety of electronic devices such as televisions, computer monitors, smart phones, tablets and digital cameras.

A liquid crystal display may include two display substrates and a liquid crystal layer that is interposed therebetween. Liquid crystal molecules of the liquid crystal layer may exhibit dielectric anisotropy. Thus, the liquid crystal display may obtain a desired image by applying an electric field to the liquid crystal layer to determine the orientation of the liquid crystal molecules, and then, adjusting an intensity of the electric field to control the transmittance of light passing through the liquid crystal display.

The liquid crystal display may include a plurality of integrated circuits (ICs) to display images. However, the ICs may malfunction or become damaged due to static electricity (e.g., electrostatic discharge (ESD)). A malfunction caused by ESD may be classified into hard and soft fails. A hard fail occurs when the IC is permanently damaged by the ESD, for example. A soft fail occurs when the IC momentarily malfunctions due to the ESD, but then quickly returns to a normal state, for example.

Therefore, there is a need for a display device capable of operating stably irrespective of noise.

SUMMARY

An exemplary embodiment of the inventive concept provides a timing controller capable of operating stably when noise is introduced.

An exemplary embodiment of the inventive concept provides a display device including the timing controller.

According to an exemplary embodiment of the inventive concept, a timing controller includes a noise detection circuit and a setting control unit. The noise detection circuit includes a first detection unit and a reset signal generating unit. The first detection unit outputs a detection signal having a first logic level based on at least one of a plurality of reference data toggling asynchronous with a clock signal. The reset signal generating unit outputs a reset signal having a second logic level based on the detection signal. The setting control unit stores setting data and initializes the setting data in response to the reset signal having the second logic level, and the setting data are used to process red, green and blue (RGB) image data.

In an exemplary embodiment of the inventive concept, the setting control unit may include a register map which stores the setting data and the register map includes a plurality of flip-flops.

The plurality of flip-flops may be connected in series and sequentially output the setting data in synchronization with the clock signal.

In an exemplary embodiment of the inventive concept, the setting control unit may provide the setting data to at least one of a plurality of function blocks configured to process the RGB image data to provide image data.

In an exemplary embodiment of the inventive concept, the first detection unit may include a reference data generating unit which includes first through fourth flip-flops respectively outputting first through fourth reference data and a detection signal generating unit which provides the detection signal based on a first pair of the reference data and a second pair of the reference data. Each of the first through fourth flip-flops operates in synchronization with the clock signal and each of the first through fourth flip-flops has an inverted output terminal connected to an input terminal thereof. The first pair of the reference data has the same phase with respect to each other and the second pair of the reference data has an inverse phase with respect to the first pair of the reference data.

The first pair of the reference data may include the first and third reference data and the second pair of the reference data may include the second and fourth reference data. The detection signal generating unit may include a first exclusive NOR gate which performs an exclusive NOR operation on the first and second reference data, a first exclusive OR gate which performs an exclusive OR operation on the second and fourth reference data, a second exclusive OR gate which performs an exclusive OR operation on the first and third reference data, a second exclusive NOR gate which performs an exclusive NOR operation on the third and fourth reference data and an OR gate which performs an OR operation on outputs of the first exclusive NOR gate, the first exclusive OR gate, the second exclusive OR gate and the second exclusive NOR gate to provide the detection signal.

The first and third flip-flops may each include a reset terminal receiving the reset signal, and the second and fourth flip-flops each include a set terminal receiving the reset signal.

The first and third flip-flops are reset and the second and fourth flip-flops are set when the reset signal has the second logic level.

The reset signal generating unit may include a fifth flip-flop which operates in synchronization with the clock signal and receives the detection signal and an AND gate which performs an AND operation on an inverted output of the fifth flip-flop and an external reset signal to provide the reset signal.

In an exemplary embodiment of the inventive concept, the timing controller further includes a second detection unit which outputs a detection signal. This detection signal has the first logic level based on at least one of another plurality of reference data toggling asynchronous with the clock signal. The reset signal generating unit may provide the reset signal having the second logic level based on the detection signals of the first and second detection units.

The reset signal generating unit may output the reset signal having the first logic level when all of the plurality of reference data in the first detection unit are synchronous with the clock signal.

Each of the first and second detection units may include a reference data generating unit which includes first through fourth flip-flops respectively outputting first through fourth reference data and a detection signal generating unit configured to provide the detection signal based on a first pair of the reference data and a second pair of the reference data. Each of the first through fourth flip-flops operates in synchronization with the clock signal, and each of the first through fourth flip-flops has an inverted output terminal connected to an input terminal thereof. The first pair of the reference data has the same phase with respect to each other and the second pair of the reference data has an inverse phase with respect to the first pair of the reference data.

The reset signal generating unit may include an OR gate which performs an OR operation on the detection signals of the first and second detection units, a fifth flip-flop which operates in synchronization with the clock signal and receives an output of the OR gate and an AND gate which performs an AND operation on an inverted output of the fifth flip-flop and an external reset signal to provide the reset signal.

According to an exemplary embodiment of the inventive concept, a display device includes a display panel including a plurality of pixels connected to a plurality of gate lines and a plurality of data lines; a data driving unit configured to apply data signals to the display panel based on a data control signal and image data; a gate driving unit configured to apply gate signals to the display panel based on a gate control signal; and a timing controller configured to generate the data control signal and the gate control signal and process red, green and blue (RGB) image data to provide the image data to the data driving unit. The timing controller includes a noise detection circuit and a setting control unit. The noise detection circuit includes a detection unit and a reset signal generating unit. The detection unit outputs a detection signal having a first logic level based on at least one of a plurality of reference data toggling asynchronous with a clock signal. The reset signal generating unit outputs a reset signal having a second logic level based on the detection signal. The setting control unit stores setting data and initializes the setting data in response to the reset signal having the second logic level, and the setting data are used to process the RGB image data.

In an exemplary embodiment of the inventive concept, the detection unit includes a plurality of flip-flops.

In an exemplary embodiment of the inventive concept, a timing controller includes a plurality of function blocks; a noise detection unit configured to output a reset signal having a first logic level when at least one of a plurality of reference data toggle asynchronous with a clock and a reset signal having a second logic level when all of the reference data toggle synchronously with the clock; and a setting controller unit configured to initialize setting data stored therein and provide the initialized setting data to at least one of the function blocks in response to the reset signal having the first logic level.

The function blocks include an adaptive color correction unit, a control signal generator or a format conversion unit.

The noise detection unit includes a first detection circuit that includes the same number of flip flops as a register map which stores the setting data in the setting controller unit.

The flip flops in the register map operate with a power supply voltage.

The noise detection unit includes a second detection circuit adjacent to at least one of the function blocks.

BRIEF DESCRIPTION OF THE DRAWINGS

The above and other features of the inventive concept will become more apparent by describing in detail exemplary embodiments thereof with reference to the accompanying drawings.

FIG. 11 is a table illustrating logic levels of a reset signal and outputs of flip-flops of the noise detection circuit shown in FIG. 7, according to an exemplary embodiment of the inventive concept.

FIG. 14 is a table illustrating logic levels of various signals of the noise detection circuit shown in FIG. 13, according to an exemplary embodiment of the inventive concept.

DETAILED DESCRIPTION OF THE EMBODIMENTS

Exemplary embodiments of the inventive concept will be described more fully hereinafter with reference to the accompanying drawings. The present inventive concept may, however, be embodied in many different forms and should not be construed as limited to the exemplary embodiments set forth herein.

It will be understood that when an element is referred to as being "connected" or "coupled" to another element, it can be directly connected or coupled to the other element or intervening elements may be present.

As used herein, the singular forms "a," "an" and "the" are intended to include the plural forms as well, unless the context clearly indicates otherwise.

Figure 1:
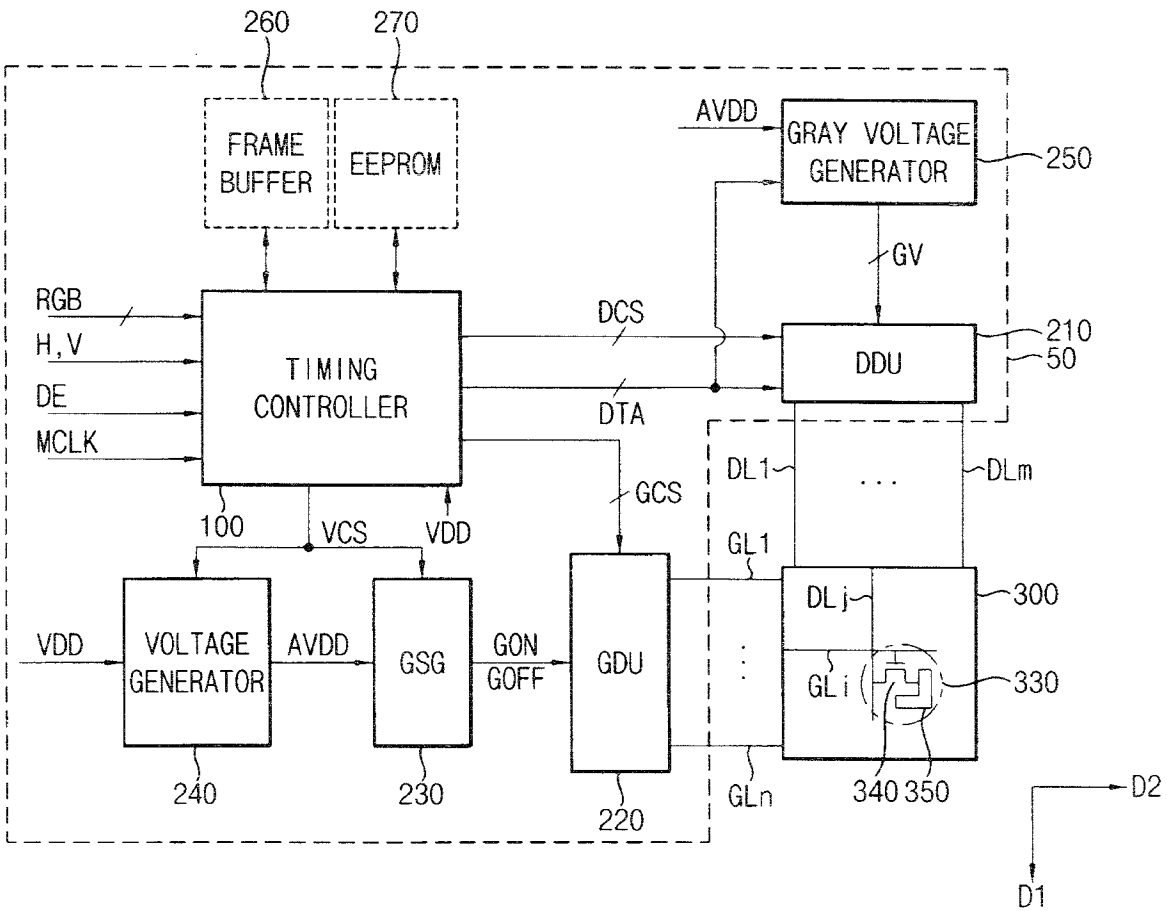
FIG. 1 is a block diagram illustrating a display device according to an exemplary embodiment of the inventive concept.

FIG. 1 is a block diagram illustrating a display device according to an exemplary embodiment of the inventive concept.

Referring to FIG. 1, a display device 10 may include a driving circuit 50 and a display panel 300.

The driving circuit 50 may include a timing controller 100, a data driving unit 210, a gate driving unit 220, a gate signal generator 230, a voltage generator 240 and a gray voltage generator 250. The driving circuit 50 may further include a frame buffer 260 and an electrically erasable programmable read-only memory (EEPROM) 270. The frame buffer 260 and the EEPROM 270 may be located external to the driving circuit 50.

The display panel 300 includes a plurality of data lines DL1~DLm, (where m is a natural number greater than two), a plurality of gate lines GL1~GLn, (where n is a natural number greater than two) and a plurality of pixels 330.

The display panel 300 may display images based on image data from the data driving unit 210 and gate signals (e.g., scan pulses) from the gate driving unit 220.

The data driving unit 210 may apply data signals corresponding to image data DTA to the data lines DL1~DLm based on a data control signal DCS from the timing controller 100. Here, the image data DTA may be generated by selecting gray voltages GV generated by the gray voltage generator 250. In an exemplary embodiment of the inventive concept, the gray voltage generator 250 may generate pairs of gray voltages (e.g., one having a positive polarity relative to a common voltage, and another having a negative polarity relative to the common voltage). The data driving unit 210 may determine polarities of the data signals by selecting gray voltages of the positive polarity, or gray voltages of the negative polarity. Hence, the data signals may have a positive polarity relative to a common voltage, or a negative polarity relative to the common voltage. In an exemplary embodiment of the inventive concept, the data control signal DCS may include a polarity control signal that controls the polarities of the data signals. Based on such a polarity control signal, the display device 10 may periodically invert the polarities of the data signals applied to the data lines DL1~DLm. In each frame, for example, the display device 10 may apply data signals of a first polarity to even data lines, and may apply data signals of a second polarity to odd data lines. The display device 10 may invert the polarities of the data signals provided to the display panel 300 at each frame.

The gate driving unit 220 may apply gate signals to gate lines GL1~GLn of the display panel 300 based on a gate control signal GCS. The gate control signal GCS may be output from the timing controller 100. In each frame, the gate signals (e.g., scan pulses) may be sequentially shifted. The gate driving unit 220 may receive a gate-on signal GON and a gate-off signal GOFF and may sequentially apply the scan pulses to the gate lines GL1~GLn based on the gate control signal GCS.

The timing controller 100 may generate the gate control signal GCS and the data control signal DCS, which control driving timings for the display device 10. The timing controller 100 may generate a voltage control signal VCS for controlling the gate signal generator 230. In an exemplary embodiment of the inventive concept, the timing controller 100 may receive a red, green, blue (RGB) image signal, a horizontal synchronization signal H, a vertical synchronization signal V, a main clock MCLK, a data enable signal DE, etc. from an external graphic controller (not illustrated), and may generate the gate control signal GCS, the data control signal DCS and the image data DTA based on these signals. For example, the gate control signal GCS may include a vertical synchronization start signal that controls an output start timing of the gate signals, a gate clock signal that controls an output timing of the gate signals, an output enable signal that controls a duration of the gate signals, etc. In addition, the data control signal DCS may include a horizontal synchronization start signal that controls an input start timing of the data signals, a load signal that applies the data signals to the data lines DL1~DLm, a polarity control signal that periodically inverts the polarities of the data signals, etc. The RGB image signal is processed by the timing controller 100 to be suitable for the operating conditions of the display device 300 and is provided as the image data DTA. The frame buffer 260 may store image signals processed by the timing controller 100 as a frame unit, and provide the timing controller 100 with previously stored image signals of a frame unit. The EEPROM 270 may store setting data which are required for the timing controller 100 to process the RGB image signals RGB and may provide the timing controller 100 with the stored setting data. The timing controller 100 operates with a power supply voltage VDD, and the power supply voltage VDD may be externally provided, or the voltage generator 240 may generate the power supply voltage VDD and provide it to the timing controller 100. The architecture and operation of the timing controller 100 will be described in detail with reference to FIG. 3.

The voltage generator 240 may receive the power supply voltage VDD from the external and generate a driving voltage AVDD based on the voltage control signal VCS. The voltage generator 240 may provide the driving voltage AVDD to the gate signal generator 230 and the gray voltage generator 250. The gate signal generator 230 may generate the gate-on signal GON and the gate-off signal GOFF based on the driving voltage AVDD according to the voltage control signal VCS to provide the gate-on signal GON and the gate-off signal GOFF to the gate driving unit 220. The gray voltage generator 250 may generate the gray voltage GV based on the driving voltage AVDD to provide the gray voltage GV to the data driving unit 210.

The data lines DL1~DLm are formed on the display panel 300 while extending in a first direction D1. The data lines DL1~DLm are aligned in a second direction D2, which is substantially perpendicular to the first direction D1, while being spaced apart from each other. The data lines DL1~DLm include a metallic material, first ends of which are electrically connected with the data driving unit 210. The data lines DL1~DLm are connected with the pixels 330 to provide the data signals from the data driving unit 210 to the pixels 330.

The gate lines GL1~GLn are formed on the display panel 300, and are aligned perpendicular to the data lines DL1~DLm while being insulated from the data lines DL1~DLm. In other words, the gate lines GL1~GLn extend in the second direction D2 and are spaced apart from each other in the first direction D1. The gate lines GL1~GLn include a metallic material, first ends of which are electrically connected with the gate driving unit 220. The gate lines GL1~GLn are connected to the pixels 330 to provide the gate signals generated from the gate driving unit 220 to the pixels 330.

Each pixel 330 includes a switching element 340 implemented with a thin film transistor (TFT), which is electrically connected to a corresponding data line DLj and a corresponding gate line GLi, and a pixel electrode 350 which is electrically connected to the switching element 340.

In an exemplary embodiment of the inventive concept, the gate driving unit 220 and the display panel 300 may be mounted as an assembly of the display panel 300, and the data driving unit 210 and the timing controller 100 may be respectively mounted on the assembly of the display panel 300 or may be mounted on a flexible printed circuit (FPC) film on a tape carrier package (TCP). Alternatively, the data driving unit 210 and the timing controller 100 may be integrated with the assembly of the display panel 300 with the gate lines GL1~GLn and the data lines DL1~DLm. In addition, the gate driving unit 220, the data driving unit 210 and the timing controller 100 may be integrated into a single chip.

Figure 2:
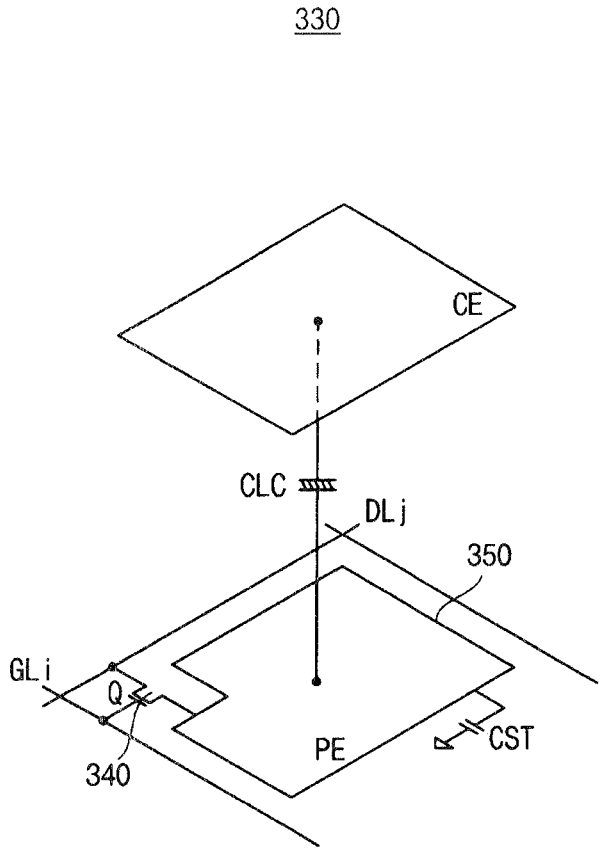
FIG. 2 is a diagram illustrating a structure of a pixel shown in FIG. 1, according to an exemplary embodiment of the inventive concept.

FIG. 2 is a diagram illustrating a structure of the pixel 330 shown in FIG. 1, according to an exemplary embodiment of the inventive concept. Each of the pixels 330 may be configured this way.

Referring to FIG. 2, each of the pixels 330 may include the switching element 340 (also denoted by Q), a liquid crystal capacitor CLC, and a storage capacitor CST.

The switching element 340 (e.g., a TFT) may provide a data signal to the liquid crystal capacitor CLC in response to a gate signal. As illustrated in FIG. 2, the gate signal may be input from the gate-line GLi, and the data signal may be input from the data-line DLj. The switching element Q may be coupled to the gate-line GLi via its gate terminal, may be coupled to the data-line DLj via its source terminal, and may be coupled to the liquid crystal capacitor CLC via its drain terminal. The liquid crystal capacitor CLC may be charged by a voltage difference between the data signal and a common voltage. The data signal may be applied to the pixel electrode 350 (also denoted by PE) of the liquid crystal capacitor CLC, and the common voltage may be applied to a common electrode CE of the liquid crystal capacitor CLC. A liquid crystal layer may be placed between the pixel electrode 350 and the common electrode CE. Hence, the light transmittance of the liquid crystal layer may be controlled by an intensity of an electric field (e.g., a charged voltage) formed between the pixel electrode 350 and the common electrode CE. In the case of a normally black mode, for example, the light transmittance of the liquid crystal layer may increase as the intensity of the electric field formed between the pixel electrode 350 and the common electrode CE increases. In an exemplary embodiment of the inventive concept, the liquid crystal capacitor CLC may include the pixel electrode 350, the common electrode CE and the liquid crystal layer placed between the pixel electrode 350 and the common electrode CE.

Figure 3:
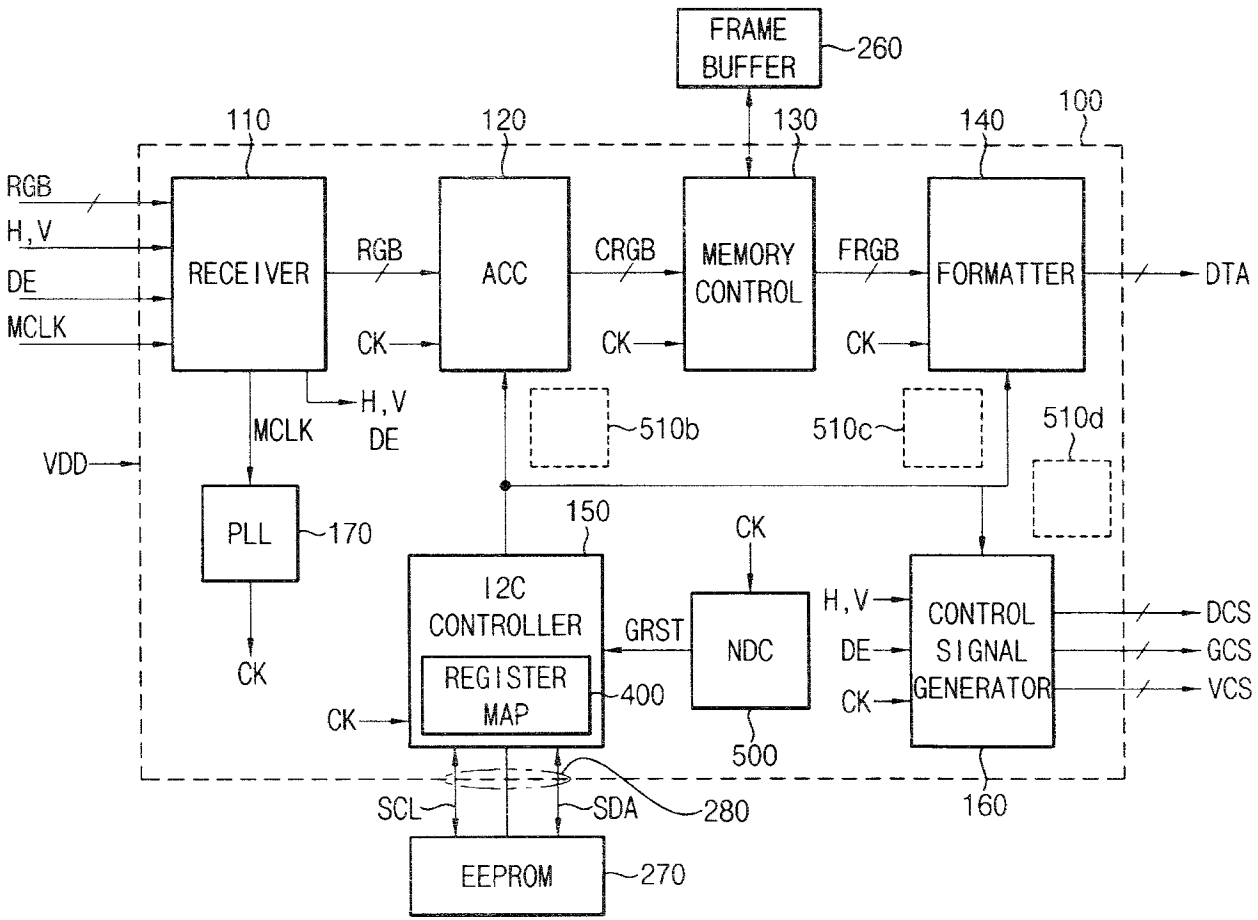
FIG. 3 is a block diagram illustrating a timing controller shown in FIG. 1 according to an exemplary embodiment of the inventive concept.

FIG. 3 is a block diagram illustrating the timing controller 100 shown in FIG. 1 according to an exemplary embodiment of the inventive concept.

In FIG. 3, the frame buffer 260 and the EEPROM 270 are both illustrated for the sake of convenience.

Referring to FIG. 3, the timing controller 100 may include a receiving unit 110, an adaptive color correction (ACC) unit 120, a memory control unit 130, a format conversion unit 140, a setting control unit (I2C controller) 150, a noise detection circuit 500, a control signal generator 160 and a phase-locked loop (PLL) circuit 170. In an exemplary embodiment of the inventive concept, the timing controller 100 may further include a plurality of detection units 510*b*, 510*c* and 510*d*. The receiving unit 110, the ACC unit 120, the memory control unit 130, the format conversion unit 140, the control signal generator 160 and the PLL circuit 170 may be referred to as a plurality of function blocks. The timing controller 100 operates with the power supply voltage VDD, and the power supply voltage VDD may be externally provided to the timing controller 100, or the voltage generator 240 may generate the power supply voltage VDD and provide it to the timing controller 100. The power supply voltage VDD may be provided to the receiving unit 110, the ACC unit 120, the memory control unit 130, the format conversion unit 140, the setting control unit 150, the noise detection circuit 500, the control signal generator 160 and the PLL circuit 170.

The receiving unit 110 receives the RGB image signals RGB, the horizontal synchronization signal H, the vertical synchronization signal V, the data enable signal DE and the main clock signal MCLK in a low voltage differential signaling (LVDS) scheme. The LVDS scheme is an interface standard for high speed data transmission. The LVDS interface may transmit digital information to a display device with high speed, use low voltage, consume little power and have high noise immunity. The receiving unit 110 provides the RGB image signals RGB to the ACC unit 120 and provides the main clock signal MCLK to the PLL circuit 170. In addition, the receiving unit 110 provides the horizontal synchronization signal H, the vertical synchronization signal V and the data enable signal DE to the control signal generator 160.

The ACC unit 120 performs an ACC, and the ACC unit 120 may correct respective R, G and B gamma curves independently to correct the red, green and blue colors. As a result, the ACC unit 120 transforms input data to output data having more bits than the input data. The ACC unit 120 may, however, use dithering so that the number of bits in the output data does not increase and remains the same as the number of bits in the input data. In other words, the ACC unit 120 receives the RGB image signals RGB and corrects each color represented thereby to output corrected RGB image data CRGB.

The memory control unit 130 exchanges the corrected image data CRGB with the frame buffer 260 as a frame unit. The memory control unit 130 may provide the frame buffer 260 with corrected image data CRGB for a current frame, and may receive from the frame buffer 260 corrected image data CRGB for a previous frame. In an exemplary embodiment of the inventive concept, the memory control unit 130 may include a data compression unit, may compress the corrected image data CRGB to be provided to the frame buffer 260, and may decompress the corrected image data CRGB provided from the frame buffer 260 to provide the decompressed corrected image data CRGB as frame-unit FRGB data to the format conversion unit 140.

The format conversion unit (or formatter) 140 converts a format of the frame-unit FRGB data to a format to be displayed on the display panel 300 and outputs it as the image data DTA. In an exemplary embodiment of the inventive concept, the format conversion unit 140 may include a dynamic capacitance compensation unit (not illustrated). The dynamic capacitance compensation (DCC) unit may perform DCC. In DCC, previous image data applied to the previous frame is compared with current image data applied to a current frame to correct the image data applied to the current frame, thereby reducing charging time. The DCC unit may generate corrected current image data by correcting image data of one frame with respect to one pixel based on image data of previous frame with respect to the one pixel.

The control signal generator 160 may generate the data control signal DCS, the gate control signal GCS and the voltage control signal VCS based on the horizontal synchronization signal H, the vertical synchronization signal V and the data enable signal DE. The data control signal DCS may be provided to the data driving unit 210 and the gate control signal GCS may be provided to the gate driving unit 220.

The setting control unit 150 includes a register map 400, and provides the ACC unit 120, the format conversion unit 140 and the control signal generator 160 with setting data required for the ACC unit 120, the format conversion unit 140 and the control signal generator 160 to perform their respective functions. The setting data may be stored in the register map 400. In other words, the setting control unit 150 may provide at least some of the function blocks in the timing controller 100 with the setting data required for the function blocks to process the RGB image data to provide the image data DTA. The setting control unit 150 may be connected with the EEPROM 270 via an interface such as (inter-integrated circuit) I2C bus 280. The I2C bus 280 may include a serial clock line SCL and a serial data line SDA. When the power supply voltage VDD is applied to the I2C bus 280, a clock signal is transmitted to the timing controller 100 (more particularly, to the setting control unit 150) through the serial clock line SCL, and setting data is transmitted to the setting control unit 150 through the serial data line SDA. The setting data is stored in the register map 400, and the setting data stored in the register map 400 may be provided to the ACC unit 120, the format conversion unit 140 and the control signal generator 160. In addition, the setting control unit 150 may be connected to an external host (not illustrated) through an interface such as the I2C bus 280.

As will be described with reference to FIG. 4, the register map 400 includes a plurality of registers, and each of the registers includes a plurality of flip-flops. In addition, since the timing controller 100 receives signals and data from an external source, noise such as electrostatic discharge (ESD) may be introduced into the timing controller 100. When ESD is introduced into the timing controller 100, the setting data stored in the flip-flops included in the register map 400 may be randomly changed. When the setting data which are randomly changed are provided to at least some of the function blocks, those function blocks perform their respective functions according to the changed setting data. Therefore, wrong image data DTA and wrong control signals DCS, GCS and VCS may be provided to the voltage generator 240, the gate signal generator 230, the data driving unit 210 and the gate driving unit 220. Accordingly, the display panel 300 may display an abnormal image.

To prevent the abnormal image from being displayed due to noise such as ESD, the timing controller 100 includes a noise detection circuit 500. As will be described with reference to FIGS. 6 through 11, the noise detection circuit 500 includes a detection unit 510/510*a* which is implemented with the same type of flip-flops as the flip-flops included in the register map 400, and may initialize the setting data stored in the register map 400 by a reset signal GRST, when reference data of the flip-flops included in the detection unit 500/510*a* are randomly changed due to noise such as ESD. Therefore, even when the ESD is introduced into the timing controller 100, the display panel 300 may display a normal image by initializing the setting data stored in the register map 400.

The PLL circuit 170 receives the main clock signal MCLK from the receiving unit 110, and generates a clock signal CK based on the main clock signal MCLK. The PLL circuit 170 may provide the clock signal CK to the ACC unit 120, the memory control unit 130, the format conversion unit 140, the setting control unit 150 and the noise detection circuit 500. A frequency of the clock signal CK may be the same as or different from a frequency of the main clock signal MCLK.

Figure 4:
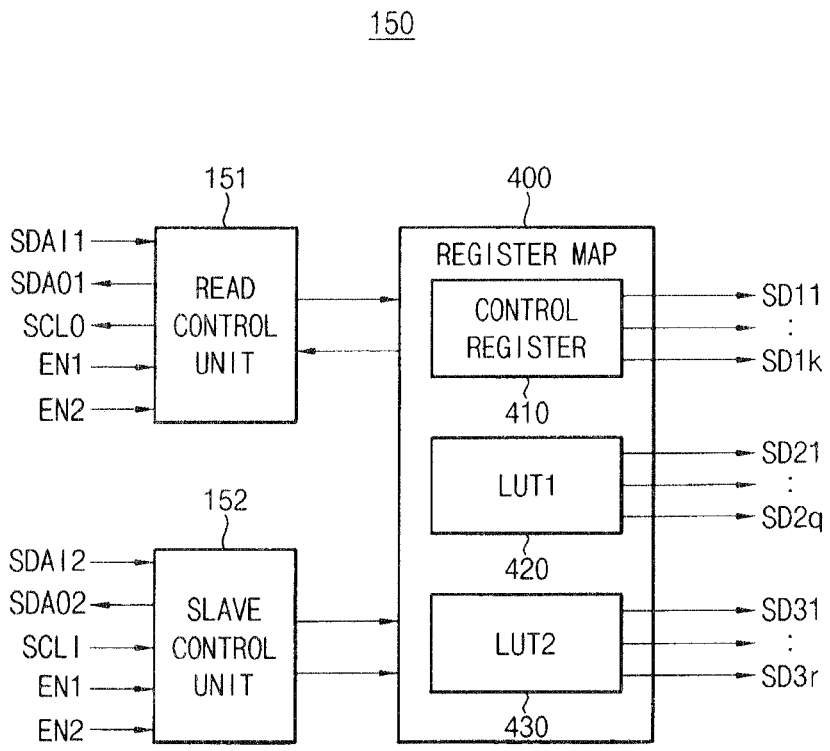
FIG. 4 is a block diagram illustrating a setting control unit shown in FIG. 3 according to an exemplary embodiment of the inventive concept.

FIG. 4 is a block diagram illustrating the setting control unit 150 shown in FIG. 3 according to an exemplary embodiment of the inventive concept.

Referring to FIG. 4, the setting control unit 150 may include a read control unit 151, a slave control unit 152 and a register map 400.

The read control unit 151 determines which setting data of the EEPROM 270 in FIG. 3 or of the register map 400 is used. In other words, the read control unit 151 controls updating of the register map 400. The read control unit 151 receives serial data SDA11 from the EEPROM 270, and transmits serial data SDAO1 and serial clock SCLO to the EEPROM 270. In addition, the read control unit 151 receives first and second enable signals EN1 and EN2. The read control unit 151 may determine which setting data of the EEPROM 270 in FIG. 3 or of the register map 400 is used in response to the first enable signal EN1. The slave control unit 152 may write setting data from an external host in the register map 400 in response to the second enable signal EN2. For example, when the second enable signal EN2 has a logic low level, the read control unit 151 is enabled and the read control unit 151 determines which setting data of the EEPROM 270 in FIG. 3 or of the register map 400 is used according to the a logic level of the first enable signal EN1. When the second enable signal EN2 has a logic high level, the slave control unit 152 is enabled and the slave control unit 152 writes setting data from the external host in the register map 400. The slave control unit 152 receives serial data SDAI2 and serial clock SCLI from the external host and transmits serial data SDAO2 to the external host. The external host may provide the first and second enable signals EN1 and EN2 to the read control unit 151 and the slave control unit 152.

The register map 400 may include a plurality of registers such as a control register 410, a first look-up table 420 and a second look-up table 430.

The control register 410 may store first setting data SD11~SD1*k*, and the first setting data SD11~SD1*k* may be provided to the control signal generator 160. The first setting data SD11~SD1*k* may be used for generating the control signals DCS, GCS and VCS in the control signal generator 160. The control signal generator 160 may generate the control signals DCS, GCS and VCS with timings according to the first setting data SD11~SD1*k*, based on the data enable signal DE, the vertical synchronization signal V and the horizontal synchronization signal H.

The first look-up table 420 may store second setting data SD21~SD2*q*, and the second setting data SD21~SD2*q* may be provided to the ACC unit 120. The second setting data SD21~SD2*q* may be used for performing ACC in the ACC unit 120. The second look-up table 430 may store third setting data SD31~SD3*r*, and the third setting data SD31~SD3*r* may be provided to the ACC unit 120. The third setting data SD31~SD3*r* may be associated with source gamma values used for correcting respective R, G and B gamma curves independently in the ACC unit 120.

Although not illustrated, the register map 400 may further include an additional look-up table storing fourth setting data which are provided to the format conversion unit 140.

Figure 5:
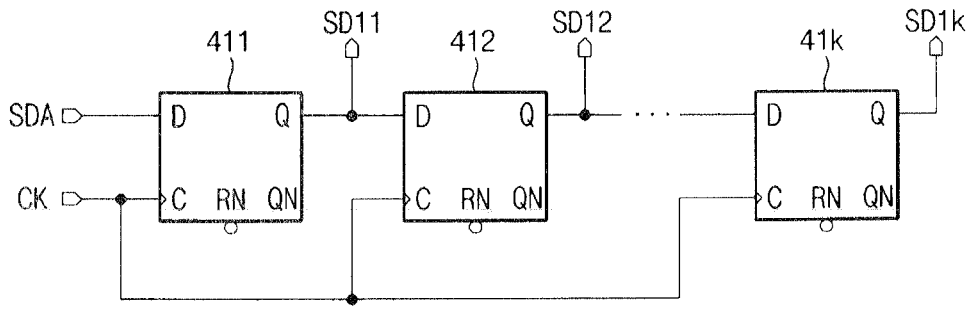
FIG. 5 illustrates a control register shown in FIG. 4 according to an exemplary embodiment of the inventive concept.

FIG. 5 illustrates the control register 410 shown in FIG. 4 according to an exemplary embodiment of the inventive concept.

Referring to FIG. 5, the control register 410 may include a plurality of flip-flops 411~41*k*. Each of the flip-flops 411~41*k* includes a data input terminal D, a clock terminal C, an output terminal Q, an inverted output terminal QN and a reset terminal RN. The clock signal CK is applied to the clock terminal C of each of the flip-flops 411~41*k*, and the flip-flops 411~41*k* are connected in series. The flip-flops 411~41*k* sequentially output the first setting data SD11~SD1*k* in synchronization with the clock signal CK.

Figure 6:
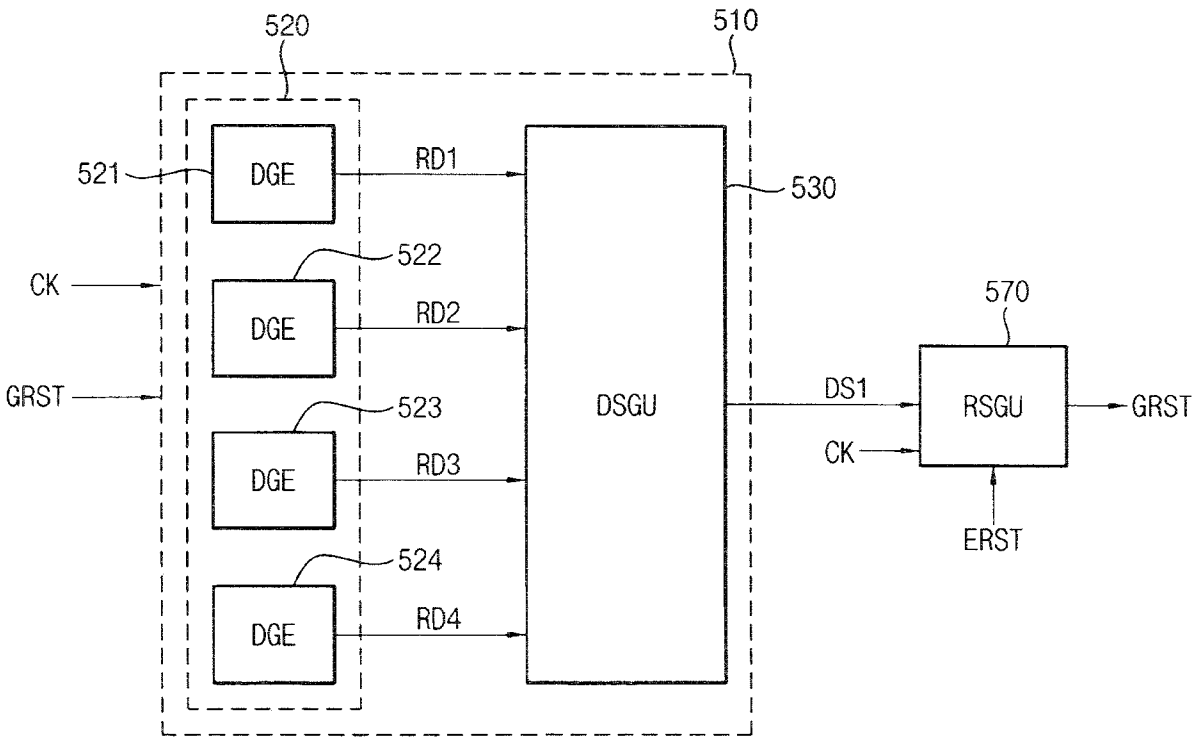
FIG. 6 is a block diagram illustrating a noise detection circuit shown in FIG. 3 according to an exemplary embodiment of the inventive concept.

FIG. 6 is a block diagram illustrating the noise detection circuit 500 shown in FIG. 3 according to an exemplary embodiment of the inventive concept.

Referring to FIG. 6, the noise detection circuit 500 may include at least one detection unit 510 and a reset signal generating unit (RSGU) 570. The at least one detection unit 510 may include a reference data generating unit 520 and a detection signal generating unit (DSGU) 530.

The reference data generating unit 520 may include a plurality of data generating elements (DGEs) 521~524. The data generating elements 521~524 may respectively generate first through fourth reference data RD1~RD4 in synchronization with the clock signal CK. The first and third reference data RD1 and RD3 have the same phase, and the second and fourth reference data RD2 and RD4 have the same phase, but which is inverse to the phase of the first and third reference data RD1 and RD3. The detection signal generating unit 530 may generate a detection signal DS1 based on the first through fourth reference data RD1~RD4. The detection signal generating unit 530 may generate the detection signal DS1 with a logic high level when at least one of the first through fourth reference data RD1~RD4 is asynchronous with the clock signal CK. The reset signal generating unit 570 may generate a reset signal GRST based on the detection signal DS1 and an external reset signal ERST. The reset signal generating unit 570 may generate the reset signal QRST with a logic low level when at least one of the first through fourth reference data RD1~RD4 is asynchronous with the clock signal CK.

Figure 7:
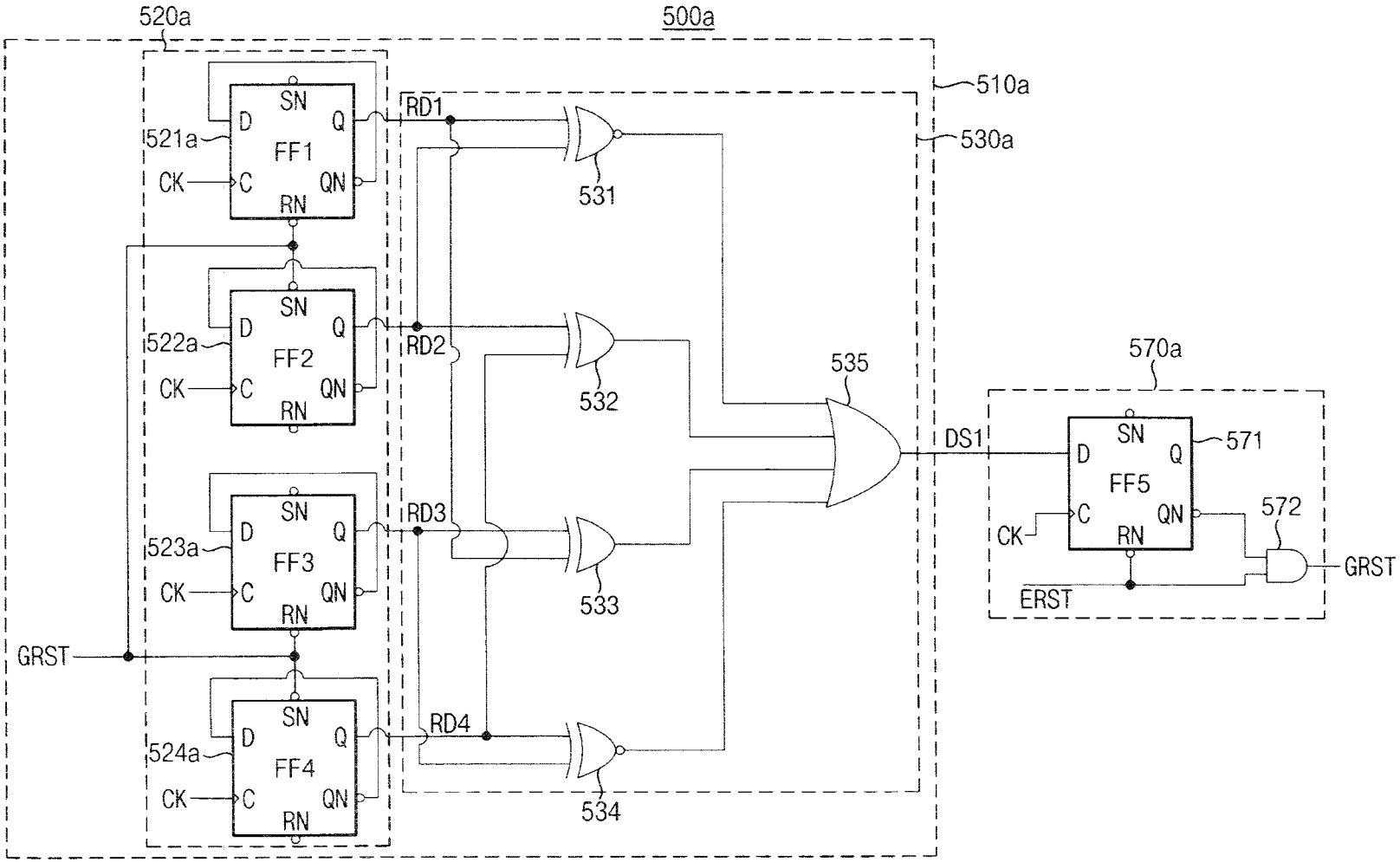
FIG. 7 is a block diagram illustrating the noise detection circuit in FIG. 6 according to an exemplary embodiment of the inventive concept.

FIG. 7 is a block diagram illustrating the noise detection circuit in FIG. 6 according to an exemplary embodiment of the inventive concept.

Referring to FIG. 7, a noise detection circuit 500*a* may include at least one detection unit 510*a* and a reset signal generating unit 570*a*. The at least one detection unit 510*a* may include a reference data generating unit 520*a* and a detection signal generating unit 530*a*. The reference data generating unit 520*a* may include first through fourth flip-flops 521*a*~524*a*. In other words, each of the data generating elements 521~524 may be implemented with a flip-flop. Each of the first through fourth flip-flops 521*a*~524*a* includes a data input terminal D, a clock terminal C, an output terminal Q, an inverted output terminal QN, a set terminal SN and a reset terminal RN, and the inverted output terminal QN is fed-back to the data input terminal D. Each of the first through fourth flip-flops 521*a*~524*a* outputs first through fourth reference data RD1~RD4 at its data output terminal Q in synchronization with the clock signal CK. The first and third reference data (a first pair of reference data) RD1 and RD3 have the same phase, and the second and fourth reference data (a second pair of reference data) RD2 and RD4 have the same phase, but which is inverse to the phase of the first and third reference data RD1 and RD3.

The detection signal generating unit 530*a* may include exclusive NOR gates 531 and 534, exclusive OR gates 532 and 533 and an OR gate 535. The exclusive NOR gate 531 performs an exclusive NOR operation on the first and second reference data RD1 and RD2. The exclusive OR gate 532 performs an exclusive OR operation on the second and fourth reference data RD2 and RD4. The exclusive OR gate 533 performs an exclusive OR operation on the first and third reference data RD1 and RD3. The exclusive NOR gate 534 performs an exclusive NOR operation on the third and fourth reference data RD3 and RD4. The OR gate 535 performs an OR operation on outputs of the exclusive NOR gates 531 and 534 and the exclusive OR gates 532 and 533 to output the detection signal DS1. Therefore, the noise detection circuit 510*a* may output the detection signal DS1 with a logic high level when at least one of the first through fourth reference data RD1~RD4 is asynchronous with the clock signal CK.

The reset signal generating unit 570*a* may include a fifth flip-flop 571 and an AND gate 572. The fifth flip-flop 571 includes a data input terminal D, a clock terminal C, an output terminal Q, an inverted output terminal QN, a set terminal SN and a reset terminal RN. The detection signal DS1 is applied to the data input terminal D of the fifth flip-flop 571, the clock signal CK is applied to the clock terminal C of the fifth flip-flop 571 and the external reset signal ERST is applied to the reset terminal RN of the fifth flip-flop 571. The AND gate 572 performs an AND operation on an output of the inverted output terminal QN of the fifth flip-flop 571 and the external reset signal ERST with a logic high level to output the reset signal GRST. For example, the reset signal GRST goes to a logic high level when the output of the inverted output terminal QN of the fifth flip-flop 571 has a logic high level in response to the detection signal DS1 with a logic low level when the first through fourth reference data RD1~RD4 toggle in synchronization with the clock signal CK. However, the reset signal GRST goes to a logic low level when the output of the inverted output terminal QN of the fifth flip-flop 571 has a logic low level in response to the detection signal DS1 with a logic high level when at least one of the first through fourth reference data RD1~RD4 is asynchronous with the clock signal CK. The reset signal GRST is applied to the reset terminal RN of the first and third flip-flops 521*a* and 523*a* and to the set terminal SN of the second and fourth flip-flops 522*a* and 524*a*. When the reset signal GRST with a logic low level is applied to the reset terminal RN of the first and third flip-flops 521*a* and 523*a* and to the set terminal SN of the second and fourth flip-flops 522*a* and 524*a*, the first and third flip-flops 521*a* and 523*a* are reset and the second and fourth flip-flops 522*a* and 524*a* are set, and thus, the first to fourth flip-flops 521*a*~524*a* are initialized.

Figure 8:
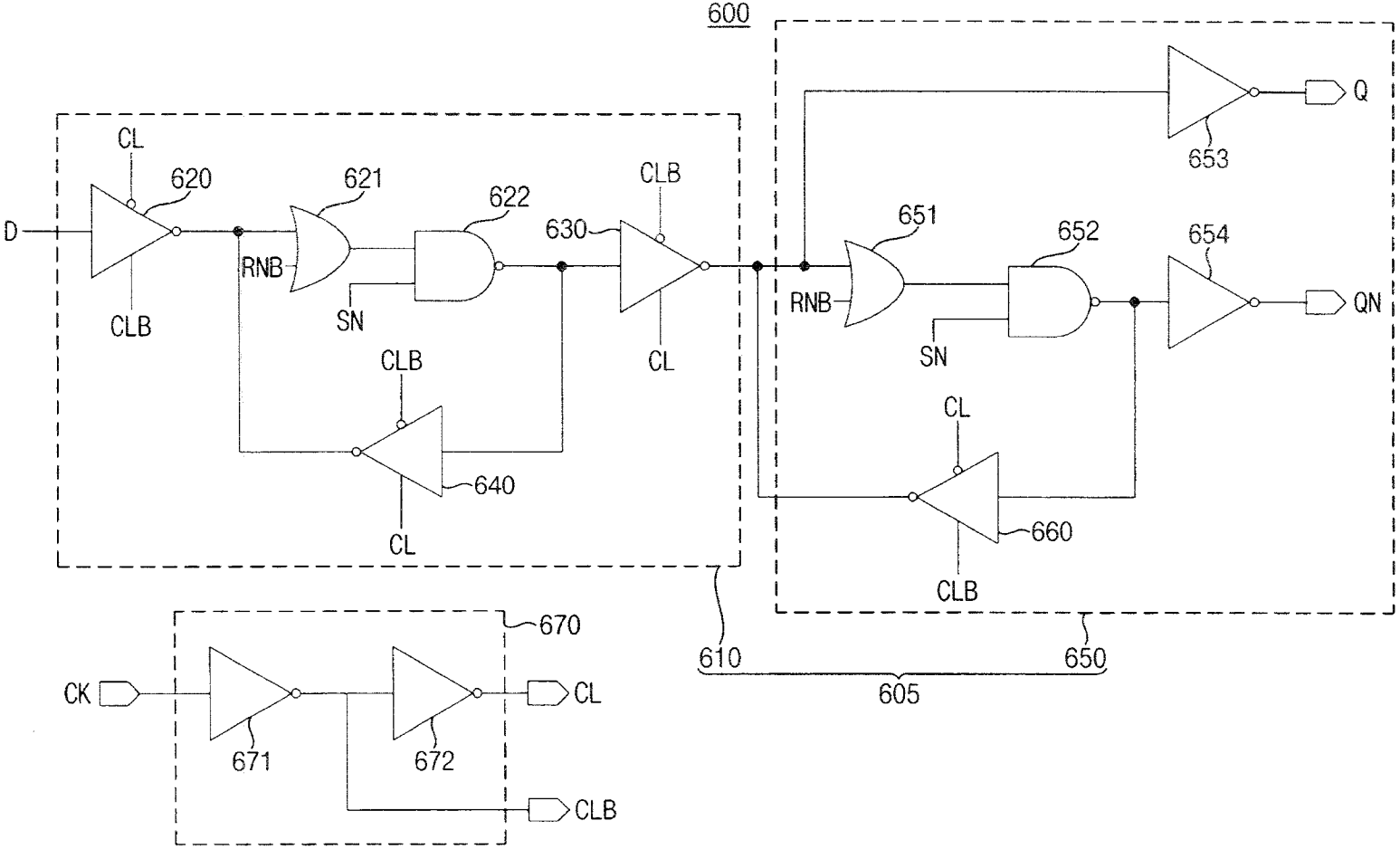
FIG. 8 is a circuit diagram illustrating a flip-flop shown in FIG. 7 according to an exemplary embodiment of the inventive concept.

FIG. 8 is a circuit diagram illustrating one of the flip-flops shown in FIG. 7 according to an exemplary embodiment of the inventive concept.

Referring to FIG. 8, a flip-flop 600 may include a data output unit 605 and a pulse generating unit 670. The data output unit 605 includes a master stage 610 and a slave stage 650. The master stage 610 latches an input D when the clock signal CK is at a logic high level. The slave stage 650 receives an input from the master stage 610 and provides as an output Q and an inverted output QN.

The master stage 610 includes a tri-state inverter 620, an OR gate 621, a NAND gate 622 and tri-state inverters 630 and 640. The slave stage 650 includes an OR gate 651, a NAND gate 652, inverters 653 and 654 and a tri-state inverter 660.

The pulse generating unit 670 includes inverters 671 and 672. The pulse generating unit 670 generates first and second pulses CL and CLB based on the clock signal CK. The first pulse CL has the same phase as the clock signal CK and the second pulse CLB has a phase inverse with respect to the phase of the clock signal CK.

Figure 9:
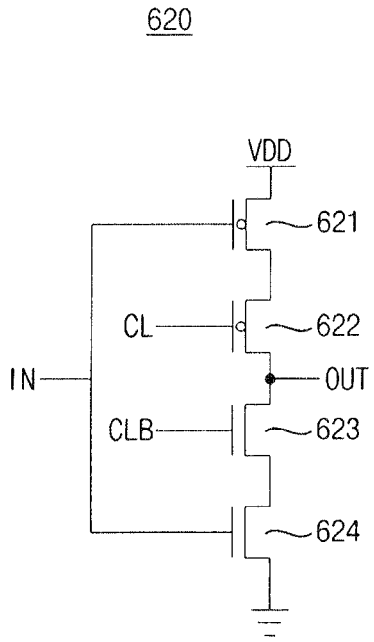
FIG. 9 illustrates a tri-state inverter shown in FIG. 8, according to an exemplary embodiment of the inventive concept.

FIG. 9 illustrates one of the tri-state inverters 620 or 660 shown in FIG. 8, according to an exemplary embodiment of the inventive concept.

Figure 10:
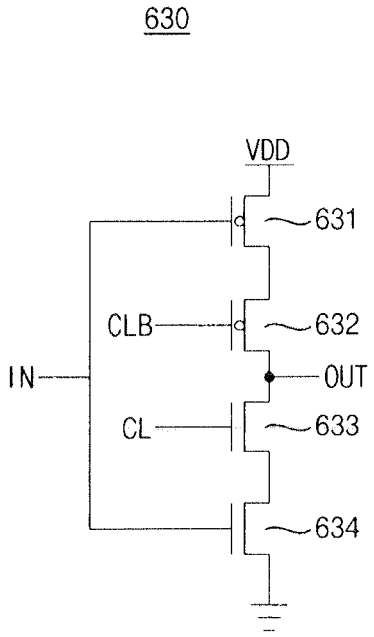
FIG. 10 illustrates a tri-state inverter shown in FIG. 8, according to an exemplary embodiment of the inventive concept.

FIG. 10 illustrates one of the tri-state inverters 630 or 640 shown in FIG. 8, according to an exemplary embodiment of the inventive concept.

Referring to FIG. 9, the tri-state inverter 620 includes p-type metal-oxide semiconductor (PMOS) transistors 621 and 622 and n-type metal-oxide semiconductor (NMOS) transistors 623 and 624 which are cascode-connected between the power supply voltage VDD and a ground. An input IN is applied to gates of the transistors 621 and 624. A first pulse CL is applied to a gate of the PMOS transistor 622, and a second pulse CLB is applied to a gate of the NMOS transistor 623. An output OUT is provided at a node where the PMOS transistor 622 and the NMOS transistor 623 are connected to each other.

Referring to FIG. 10, the tri-state inverter 630 includes PMOS transistors 631 and 632 and NMOS transistors 633 and 634 which are cascode-connected between the power supply voltage VDD and a ground. An input IN is applied to gates of the transistors 631 and 634. The second pulse CLB is applied to a gate of the PMOS transistor 632, and the first pulse CL is applied to a gate of the NMOS transistor 633. An output OUT is provided at a node where the PMOS transistor 632 and the NMOS transistor 633 are connected to each other.

Referring again to FIG. 8, the tri-state inverter 620 receives the input D. The OR gate 621 receives an output of the tri-state inverter 620 and an inverted reset signal RNB. The NAND gate receives an output of the OR gate 621 and a set signal SN. The tri-state inverter 630 receives an output of the NAND gate 622. The tri-state inverter 640 is connected to the input of the tri-state inverter 630 and the output of the tri-state inverter 620. The OR gate 651 receives an output of the tri-state inverter 630 and the inverted reset signal RNB. The NAND gate 652 receives an output of the OR gate 651 and the set signal SN. The inverter 653 inverts the output of the tri-state inverter 630 to provide an output Q. The inverter 654 inverts an output of the NAND gate 652 to provide an inverted output QN. The tri-state inverter 660 is connected to the input of the inverter 654 and the output of the tri-state inverter 630.

As described with FIGS. 9 and 10, the flip-flops 521*a*~524*a* shown in FIG. 7 are provided with the power supply voltage VDD. When noise such as ESD is introduced into the timing controller 100, a level of the power supply voltage VDD fluctuates. When the level of the power supply voltage VDD fluctuates, at least one of the first through fourth reference data RD1~RD4 is randomly changed. When at least one of the first through fourth reference data RD1~RD4 is randomly changed, at least one of the first through fourth reference data RD1~RD4 toggles asynchronously with the clock signal CK, and thus the detection signal DS1 goes to a logic high level. When the detection signal DS1 has a logic high level, the reset signal GRST goes to a logic low level since the output of the inverted output terminal QN of the fifth flip-flop 571 has a logic low level. When the reset signal GRST has a logic low level, the first and fourth flip-flops 521*a* and 524*a* initialized in response to the reset signal GRST with a logic low level. In addition, the reset signal GRST is applied to the setting control unit 150 in FIG. 3. When the reset signal GRST with a logic low level is applied to the setting control unit 150, the setting control unit 150 may again receive the setting data from the EEPROM 270 and provide the setting data to some of the function blocks. Therefore, when the setting data in the register map 400 are randomly changed due to noise such as ESD, the noise detection circuit 500 may initialize the setting data by detecting the noise and providing the reset signal GRST to the setting control unit 150.

In other words, since the noise detection circuit 500 includes flip-flops having the same type (or architectures) as the flip-flops implementing the registers included in the register map 400, the noise detection circuit 500 may detect a soft-fail in which the setting data are randomly changed in the register map 400 in the setting control unit 150 and initialize the setting data stored in the register map 400 by providing the reset signal GRST when the soft-fail occurs.

FIG. 11 is a table illustrating logic levels of the reset signal GRST and outputs of the flip-flops 521*a*~524*a* and 571 of the noise detection circuit 500*a* shown in FIG. 7, according to an exemplary embodiment of the inventive concept.

In FIG. 11, FF1, FF2, FF3, FF4 and FF5/Q denote respective outputs of the flip-flops 521*a*~524*a* and 571, FF5/D denotes an input of the flip-flop 571 and FF5/QN denotes an inverted output of the flip-flop 571. In FIG. 11, the external reset signal ERST has a logic high level.

Referring to FIGS. 7 and 11, when the timing controller 100 operates normally (e.g., when an ESD does not influence the timing controller 100), the output FF5/Q of the flip-flop 571 is at a logic low level, because the detection signal DS1 (e.g., the input FF5/D of the flip-flop 571) is at a logic low level. Since the inverted output FF5/QN of the flip-flop 571 is at a logic high level, the reset signal GRST is at a logic high level. However, if at least one of the first through fourth reference data RD1~RD4 is randomly changed due to noise such as ESD introduced into the timing controller 100, the detection signal DS1 (e.g., the input FF5/D of the flip-flop 571) goes to a logic high level. Since this causes the inverted output FF5/QN of the flip-flop 571 to have a logic low level, the reset signal GRST is at a logic low level.

Figure 12:
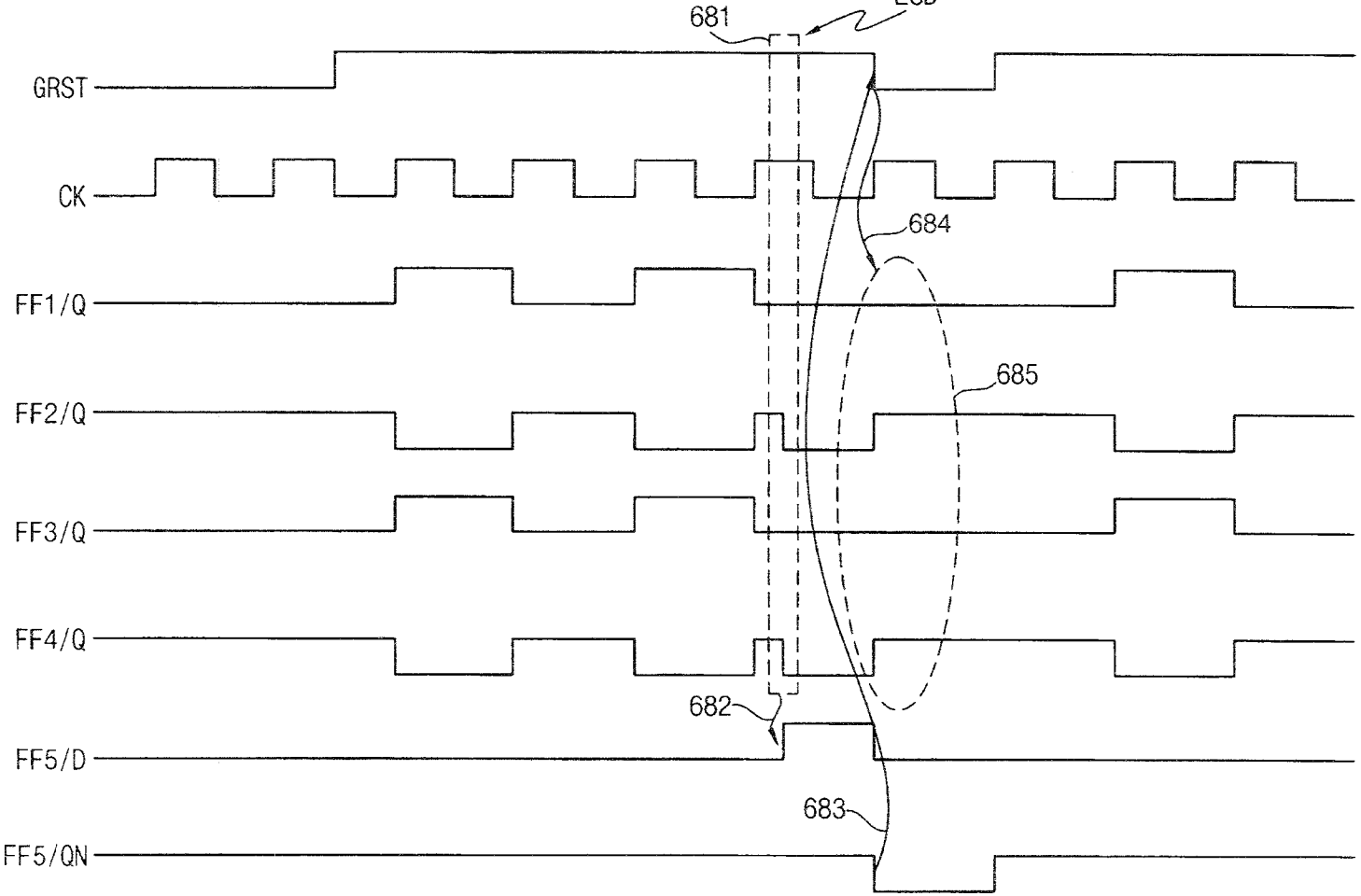
FIG. 12 is a timing diagram illustrating various signals of the noise detection circuit shown in FIG. 7, according to an exemplary embodiment of the inventive concept.

FIG. 12 is a timing diagram illustrating various signals of the noise detection circuit 500*a* shown in FIG. 7, according to an exemplary embodiment of the inventive concept.

Referring to FIGS. 7 and 12, the first pair of reference data including the first reference data RD1 or FF1/Q (e.g., the output of the flip-flop 521*a*) and the third reference data RD3 or FF3/Q (e.g., the output of the flip-flop 523*a*) having the same phase toggle in synchronization with the clock signal CK, and the second pair of reference data including the second reference data RD2 or FF2/Q (e.g., the output of the flip-flop 522*a*) and the fourth reference data RD4 or FF4/Q (e.g., the output of the flip-flop 524*a*) having the same phase, which is inverse to the phase of the first pair of reference data, toggle in synchronization the clock signal CK. When the first through and fourth reference data FF1/Q~FF4/Q continuously toggle in synchronization the clock signal CK, the reset signal GRST is at a logic high level. In other words, the timing controller 100 is not influenced by noise such as ESD. When noise such as ESD is introduced into the timing controller 100, at least one of the reference data FF1/Q~FF4/Q is randomly changed. In other words, at least one of the first through fourth reference data FF1/Q~FF4/Q toggles asynchronous with the clock signal CK as represented by reference numeral 681. When at least one of the reference data FF1/Q~FF4/Q toggles asynchronous with the clock signal CK, the detection signal DS1 (e.g., the input FF5/D of the flip-flop 571) goes to a logic high level as represented by reference numeral 682, and the inverted output FF5/QN of the flip-flop 571 goes to a logic low level after one cycle of the clock signal CK. At the time when the inverted output FF5/QN of the flip-flop 571 has a logic low level, the reset signal GRST goes to a logic low level as represented by reference numeral 683. When the reset signal GRST has a logic low level, the flip-flops 521*a*~524*a* are initialized (reference numeral 685) in response to the reset signal GRST as represented by reference numeral 684. The setting data stored in the register map 400 may also be initialized in response to the reset signal GRST with a logic low level. When the flip-flops 521*a*~524*a* are initialized, the first through fourth reference data FF1/Q~FF4/Q toggle in synchronization with the clock signal CK, thereby causing the reset signal GRST to go to a logic high level.

Figure 13:
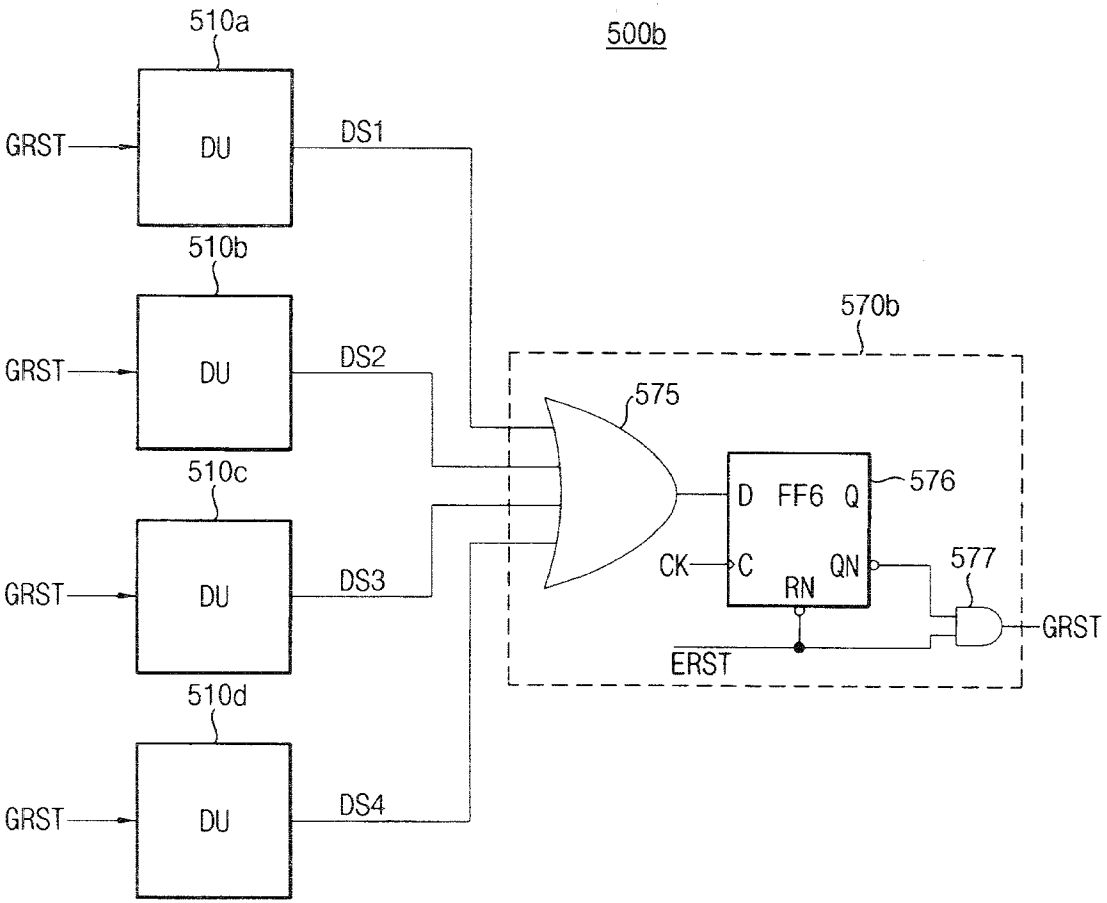
FIG. 13 is a block diagram illustrating the noise detection circuit shown in FIG. 3 according to an exemplary embodiment of the inventive concept.

FIG. 13 is a block diagram illustrating the noise detection circuit in FIG. 3 according to an exemplary embodiment of the inventive concept.

Referring to FIG. 13, a noise detection circuit 500*b* may include a plurality of detection units (DUs) 510*a*~510*d* and a reset signal generating unit 570*b*. Each of the detection units

510*a*~510*d* may be substantially the same as the detection unit 510*a* described with reference to FIG. 7, and the detection units 510*a*~510*d* may respectively output first through fourth detection signals DS1~DS4 based on toggling of the first through fourth reference data RD1~RD4. In addition, each of the detection units 510*a*~510*d* may be arranged adjacent to each of the setting control unit 150, the ACC unit 120, the format conversion unit 140 and the control signal generator 160. In addition, the reset signal GRST may be applied to the ACC unit 120, the format conversion unit 140 and the control signal generator 160.

The reset signal generating unit 570*b* may include an OR gate 575, a flip-flop 576 and an AND gate 577. The OR gate 575 performs an OR operation on the first through fourth detection signals DS1~DS4. The flip-flop 576 includes a data input terminal D, a clock terminal C, an output terminal Q, an inverted output terminal QN and a reset terminal RN. An output of the OR gate 575 is applied to the data input terminal D of the flip-flop 576, the clock signal CK is applied to the clock terminal C of the flip-flop 576 and the external reset signal ERST is applied to the reset terminal RN of the flip-flop 576. The AND gate 577 performs an AND operation on an output of the inverted output terminal QN of the flip-flop 576 and the external reset signal ERST with a logic high level to output the reset signal GRST.

Each of the first through fourth detection signals DS1~DS4 is at a logic low level, when each of the detection units 510*a*~510*d* operates normally. When all of the first through fourth detection signals DS1~DS4 have a logic low level, the input D and output Q of the flip-flop 576 have a logic low level, and thus, the inverted output QN of the flip-flop 576 is at a logic high level. Therefore, the reset signal GRST is at a logic high level. However, when at least one of the first through fourth reference data RD1~RD4 in at least one of the detection units 510*a*~510*d* toggles asynchronously with the clock signal CK, at least one of the first through fourth detection signals DS1~DS4 goes to a logic high level. When at least one of the first through fourth detection signals DS1~DS4 has a logic high level, the OR gate 575 provides an output with a high level indicating that at least one of the first through fourth reference data RD1~RD4 in at least one of the detection units 510*a*~510*d* is randomly changed due to noise such as ESD. Therefore, the input D and output Q of the flip-flop 576 go to a logic high level, and thus, the inverted output QN of the flip-flop 576 has a logic low level. Therefore, the reset signal GRST goes to a logic low level, and flip-flops respectively included in the detection units 510*a*~510*d* may be initialized in response to the reset signal GRST with a logic low level. In addition, the setting data stored in the register map 400 may be initialized in response to the reset signal GRST with a logic low level. In addition, the ACC unit 120, the format conversion unit 140 and the control signal generator 160 may be initialized in response to the reset signal GRST with a logic low level.

Flip-flops, included in the detection units 510*a*~510*d* and having the same type (or architectures) as the flip-flops implementing the registers included in the register map 400, are also included in the function blocks such as the ACC unit 120, the format conversion unit 140 and the control signal generator 160. Therefore, the timing controller 100 may minimize the influence of noise such as ESD by arranging each of the detection units 510*a*~510*d* near each of the function blocks, detect a soft fail in the function blocks based on the reference data and initialize the function blocks. Therefore, even when the soft fail occurs in the timing controller 100 due to noise such as ESD, the display device 300 may display a normal image by initializing the function blocks with the reset signal GRST.

FIG. 14 is a table illustrating logic levels of various signals of the noise detection circuit 500*b* in FIG. 13, according to an exemplary embodiment of the inventive concept.

Referring to FIGS. 13 and 14, when each of the detection units 510*a*~510*d* operates normally and each of the first through fourth detection signals DS1~DS4 is at a logic low level, the input D and output Q of the flip-flop 576 have a logic low level, and thus, the inverted output QN of the flip-flop 576 is at a logic high level. Therefore, the reset signal GRST is at a logic high level. However, when at least one of the first through fourth reference data RD1~RD4 in at least one of the detection units 510*a*~510*d* toggles asynchronously with the clock signal CK, at least one of the first through fourth detection signals DS1~DS4 goes to a logic high level. When at least one of the first through fourth detection signals DS1~DS4 has a logic high level, the OR gate 575 provides an output with a logic high level. Therefore, the input D and output Q of the flip-flop 576 go to a logic high level, and thus, the inverted output QN of the flip-flop 576 has a logic low level. Therefore, the reset signal GRST goes to a logic low level.

Figure 15:
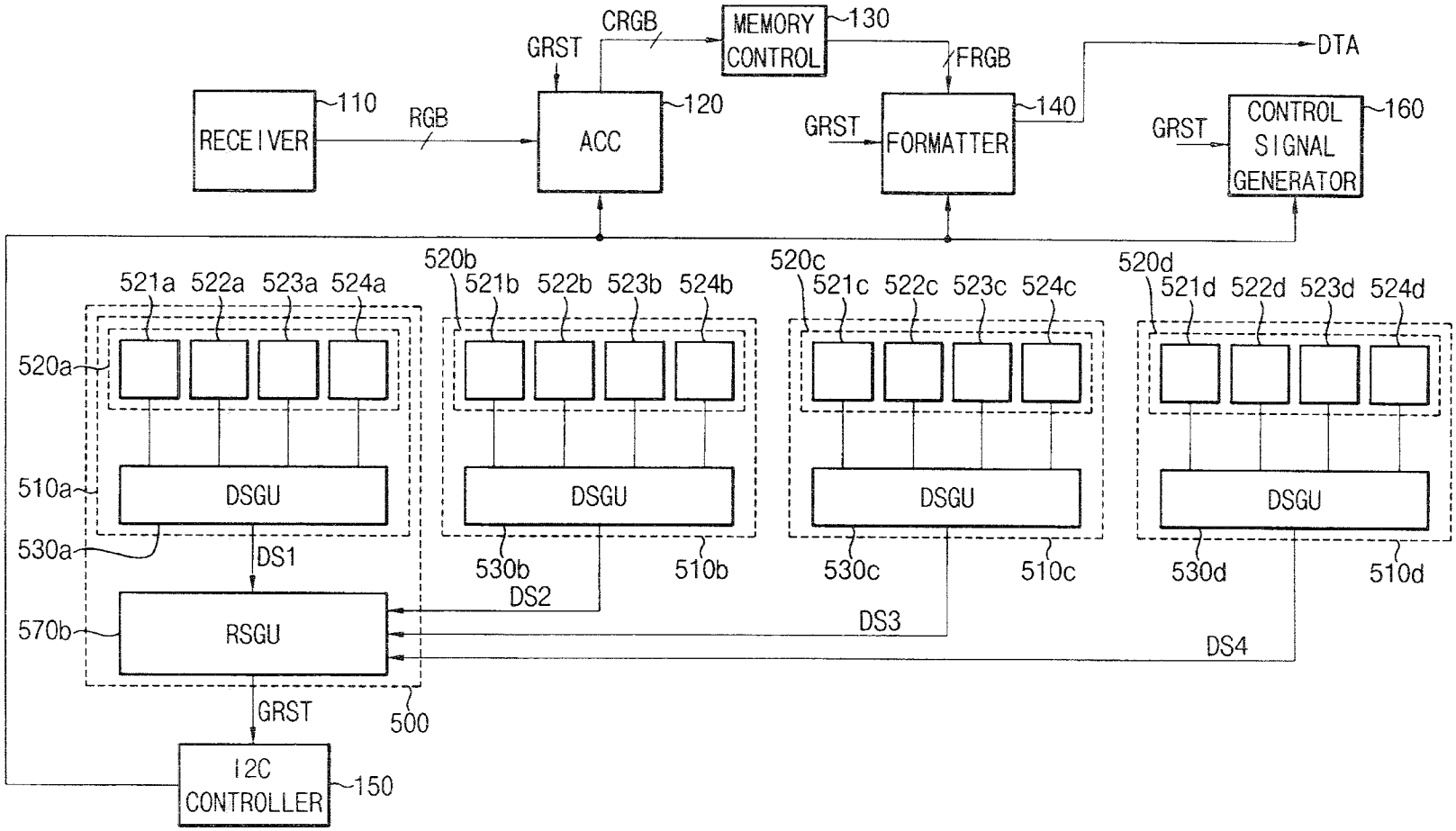
FIG. 15 illustrates an arrangement of a plurality of detection units in the timing controller of FIG. 3 according to an exemplary embodiment of the inventive concept.

FIG. 15 illustrates an arrangement of the plurality of detection units 510*a*, 510*b*, 510*c* and 510*d* in the timing controller 100 of FIG. 3 according to an exemplary embodiment of the inventive concept.

In FIG. 15, some portions of the timing controller 100 are illustrated, and FIG. 15 mainly illustrates the arrangement of the noise detection circuit 500*b* and the plurality of detection units 510*a*, 510*b*, 510*c* and 510*d* included therein.

Referring to FIG. 15, the noise detection circuit 500 is arranged adjacent to the setting control unit 150, and the noise detection circuit 500 includes the first detection unit 510*a* and the reset signal generating unit 570*b*. The first detection unit 510*a* includes the reference data generating unit 520*a* and the detection signal generating unit 530*a*. The reference data generating unit 520*a* includes the first through fourth flip-flops 521*a*~524*a*. The second detection unit 510*b* includes a reference data generating unit 520*b* and a detection signal generating unit 530*b*. The second detection unit 510*b* is arranged adjacent to the ACC unit 120. The reference data generating unit 520*b* includes first through fourth flip-flops 521*b*~524*b*. The third detection unit 510*c* includes a reference data generating unit 520*c* and a detection signal generating unit 530*c*. The third detection unit 510*c* is arranged adjacent to the format conversion unit 140. The reference data generating unit 520*c* includes first through fourth flip-flops 521*c*~524*c*. The fourth detection unit 510*d* includes a reference data generating unit 520*d* and a detection signal generating unit 530*d*. The fourth detection unit 510*d* is arranged adjacent to the control signal generator 160. The reference data generating unit 520*d* includes first through fourth flip-flops 521*d*~524*d*. The first through fourth detection units 510*a*, 510*b*, 510*c* and 510*d* are arranged adjacent to each other. Therefore, the flip-flops 521*a*~524*a*, 521*b*~524*b*, 521*c*~524*c* and 521*d*~524*d* are arranged adjacent to each other.

Figure 16:
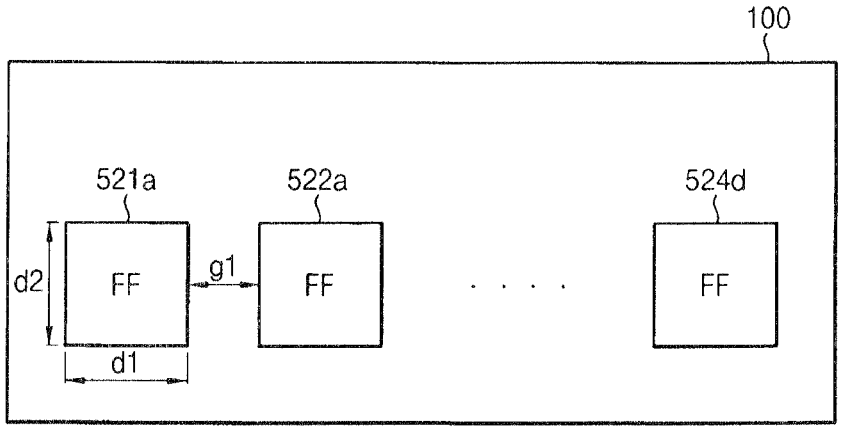
FIG. 16 illustrates an arrangement of flip-flops included in the plurality of detection units shown in FIG. 15 according to an exemplary embodiment of the inventive concept.

FIG. 16 illustrates an arrangement of the flip-flops 521*a*~524*d* included in the plurality of detection units 510*a*, 510*b*, 510*c* and 510*d* shown in FIG. 15 according to an exemplary embodiment of the inventive concept.

In FIG. 16, the flip-flops 521*a*~524*a* included in the detection unit 510*a*, flip-flops 521*b*~524*b* included in the detection unit 510*b*, flip-flops 521*c*~524*c* included in the detection unit 510*c* and flip-flops 521*d*~524*d* included in the detection unit

510*d* are illustrated without other components included in the timing controller 100 of FIG. 15 being illustrated.

Referring to FIG. 16, the flip-flops 521*a*~524*a*, 521*b*~524*b*, 521*c*~524*c* and 521*d*~524*d* are arranged in the timing controller 100, each of the flip-flops 521*a*~524*a*, 521*b*~524*b*, 521*c*~524*c* and 521*d*~524*d* may have a size defined by a first length d1 and a second length d2, and two adjacent flip-flops, for example, flip-flops 521*a* and 522*a* have a gap g1 therebetween. As illustrated in FIG. 16, when the flip-flops 521*a*~524*a*, 521*b*~524*b*, 521*c*~524*c* and 521*d*~524*d* are arranged with regular intervals in the timing controller 100, the noise detection circuit 500 may detect the soft fail due to noise such as ESD in an arbitrary position of the timing controller 100 and may initialize the setting data in the register map 400 and the setting data in the function blocks with the reset signal GRST.

Figure 17:
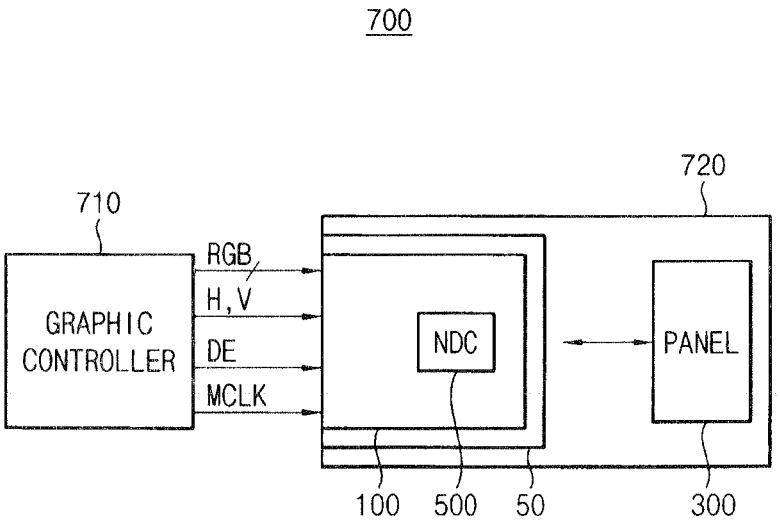
FIG. 17 is a display system including the display device of FIG. 1 according to an exemplary embodiment of the inventive concept.

FIG. 17 is a display system including the display device of FIG. 1 according to an exemplary embodiment of the inventive concept.

Referring to FIG. 17, a display system 700 may include a graphic controller 710 and a display device 720. The display device 720 may include the display panel 300 and the driving circuit 50. The display panel 300 may include the pixels 330 that are coupled to the gate lines GL1~GLn and the data lines DL1~DLm. During each frame, the driving circuit 50 may sequentially apply the gate signal to the gate lines GL1~GLn, and may apply the data voltages to the data lines DL1~DLm. The driving circuit 50 includes a timing controller 100. The timing controller 100 processes the RGB image data to provide the image data and generates a plurality of control signals for driving the display panel 300 as described with reference to FIG. 1. In addition, the timing controller 100 includes a noise detection circuit 500 having at least one detection unit which is implemented with the same type of flip-flops as the flip-flops included in the register map 400 which stores the setting data used for processing the RGB image data and generating the control signals, and thus detects a soft fail due to noise such as ESD in arbitrary position of the timing controller 100 and initializes the setting data in the register map 400 with the reset signal GRST. The graphic controller 710 provides the display device 720 with an RGB image signal, a horizontal synchronization signal H, a vertical synchronization signal V, a main clock MCLK and a data enable signal DE. The timing controller 720 may generate a gate control signal, a data control signal and image data DTA based on the RGB image signal, the horizontal synchronization signal H, the vertical synchronization signal V, the main clock MCLK and the data enable signal DE.

Figure 18:
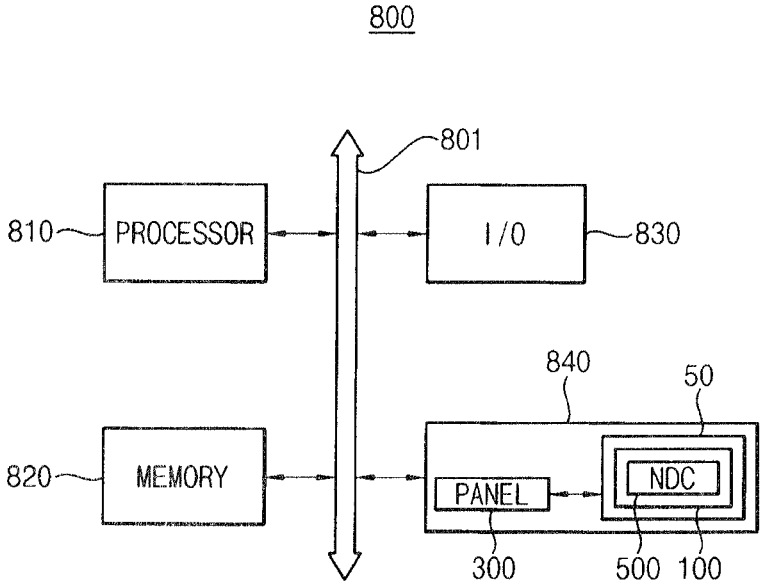
FIG. 18 is a block diagram illustrating an electronic device including the display device of FIG. 1 according to an exemplary embodiment of the inventive concept.

FIG. 18 is a block diagram illustrating an electronic device including the display device of FIG. 1 according to an exemplary embodiment of the inventive concept.

Referring to FIG. 18, an electronic device 800 may include a processor 810, a memory device 820, an input/output (I/O) device 830, and a display device 840.

The processor 810 may perform specific calculations, or computing functions for various tasks. For example, the processor 810 may correspond to a microprocessor, a central processing unit (CPU), etc. The processor 810 may be coupled to the memory device 820 via a bus 801. For example, the memory device 820 may include at least one volatile memory device such as a dynamic random access memory (DRAM) device, a static random access memory (SRAM) device, etc. and/or at least one non-volatile memory device such as an erasable programmable read-only memory (EPROM) device, an EEPROM device, a flash memory device, etc. The memory device 820 may store software performed by the processor 810. The I/O device 830 may be coupled to the bus 801. The I/O device 830 may include at least one input device (e.g., a keyboard, keypad, a mouse, etc.), and/or at least one output device (e.g., a printer, a speaker, etc.). The processor 810 may control operations of the I/O device 830.

The display device 840 may be coupled to the processor 810 via the bus 801. The display device 840 may include the display panel 300 and a driving circuit 50. The display panel 300 may include the pixels 330 that are coupled to the gate lines GL1~GLn and the data lines DL1~DLm. During each frame, the driving circuit 50 may sequentially apply the gate signal to the gate lines GL1~GLn, and may apply the data voltages to the data lines DL1~DLm. The driving circuit 50 includes a timing controller 100. The timing controller 100 processes the RGB image data to provide the image data and generates a plurality of control signals for driving the display panel 300 as described with reference to FIG. 1. In addition, the timing controller 100 includes a noise detection circuit 500 having at least one detection unit which is implemented with the same type of flip-flops as the flip-flops included in the register map 400 which stores the setting data used for processing the RGB image data and generating the control signals, and thus detects a soft fail due to noise such as ESD in an arbitrary position of the timing controller 100 and initializes the setting data in the register map 400 with the reset signal GRST.

The electronic device 800 may correspond to a digital television, a cellular phone, a smart phone, a personal digital assistant (PDA), a portable multimedia player (PMP), an MP3 player, a laptop computer, a desktop computer, a digital camera, etc.

In accordance with the exemplary embodiments of the inventive concept described above, the timing controller and the display device including the timing controller are capable of preventing an abnormal image from being displayed by detecting a soft fail due to noise such as ESD and initializing the setting data. For example, the timing controller may minimize the influence of ESD by detecting a soft fail in the function blocks based on the reference data and initializing the setting data in these blocks.

The present inventive concept may be applied to any type of device supporting a scan test, for example, semiconductor memory devices, semiconductor chips, semiconductor modules, memory cards, memory sticks and smart cards which employ I/O drivers whose operating speed is low.

While the inventive concept has been particularly shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. A timing controller, comprising:

a noise detection circuit including:

a first detection unit configured to output a detection signal having a first logic level based on at least one of a plurality of reference data toggling asynchronous with a clock signal; and a reset signal generating unit configured to output a reset signal having a second logic level based on the detection signal;

a setting control unit configured to store setting data and initialize the setting data in response to the reset signal having the second logic level, the setting data being used to process red, green and blue (RGB) image data; and a second detection unit which outputs a detection signal, this detection signal having the first logic level based on at least one of another plurality of reference data toggling asynchronous with the clock signal, and wherein the reset signal generating unit provides the reset signal having the second logic level based on the detection signals of the first and second detection units, and wherein each of the first and second detection units comprises:

a reference data generating unit which includes first through fourth flip-flops respectively outputting first through fourth reference data, each of the first through fourth flip-flops operating in synchronization with the clock signal, and each of the first through fourth flip-flops having an inverted output terminal connected to an input terminal thereof; and a detection signal generating unit configured to provide the detection signal based on a first pair of the reference data and a second pair of the reference data, first pair of the reference data having the same phase with respect to each other, and the second pair of the reference data having an inverse phase with respect to the first pair of the reference data.

2. The timing controller of claim 1, wherein the setting control unit includes a register map which stores the setting data and the register map includes a plurality of flip-flops.

3. The timing controller of claim 2, wherein the plurality of flip-flops are connected in series and sequentially output the setting data in synchronization with the clock signal.

4. The timing controller of claim 1, wherein the setting control unit provides the setting data to at least one of a plurality of function blocks configured to process the RGB image data to provide image data.

5. The timing controller of claim 1, wherein the reset signal generating unit outputs the reset signal having the first logic level when all of the plurality of reference data in the first detection unit are synchronous with the clock signal.

6. The timing controller of claim 1, wherein the reset signal generating unit comprises:

an OR gate which performs an OR operation on the detection signals of the first and second detection units;

a fifth flip-flop which operates in synchronization with the clock signal and receives an output of the OR gate; and an AND gate which performs an AND operation on an inverted output of the fifth flip-flop and an external reset signal to provide the reset signal.

7. A timing controller, comprising:

a noise detection circuit including:

a first detection unit configured to output a detection signal having first logic level based on at least one of a plurality of reference data toggling asynchronous with a clock signal; and a reset signal generating unit configured to output a reset signal having a second logic level based on the detection signal; and a setting control unit configured to store setting data and initialize the setting data in response to the reset signal having the second logic level, the setting data being used to process red, green and blue (RGB) image data, wherein the first detection unit comprises:

a reference data generating unit which includes first through fourth flip-flops respectively outputting first through fourth reference data, each of the first through fourth flip-flops operating in synchronization with the clock signal, and each of the first through fourth flip-flops having an inverted output terminal connected to an input terminal thereof; and a detection signal generating unit configured to provide the detection signal based on a first pair of the reference data and a second pair of the reference data, the first pair of the reference data having the same phase with respect to each other, and the second pair of the reference data having an inverse phase with respect to the first pair of the reference data, wherein the first and third flip-flops each include a reset terminal receiving the reset signal, and the second and fourth flip-flops each include a set terminal receiving the reset signal.

8. The timing controller of claim 7, wherein the first pair of the reference data includes the first and third reference data and the second pair of the reference data includes the second and fourth reference data, and wherein the detection signal generating unit comprises:

a first exclusive NOR gate which performs an exclusive NOR operation on the first and second reference data;

a first exclusive OR gate which performs an exclusive OR operation on the second and fourth reference data;

a second exclusive OR gate which performs an exclusive OR operation on the first and third reference data;

a second exclusive NOR gate which performs an exclusive NOR operation on the third and fourth reference data; and an OR gate which performs an OR operation on outputs of the first exclusive NOR gate, the first exclusive OR gate, the second exclusive OR gate and the second exclusive NOR gate to provide the detection signal.

9. The timing controller of claim 7, wherein the first and third flip-flops are reset and the second and fourth flip-flops are set when the reset signal has the second logic level.

10. The timing controller of claim 7, wherein the reset signal generating unit comprises:

a fifth flip-flop which operates in synchronization with the clock signal and receives the detection signal; and an AND gate which performs an AND operation on an inverted output of the fifth flip-flop and an external reset signal to provide the reset signal.

* * * * *